US010260696B2

(12) United States Patent
Kuo et al.

(10) Patent No.: US 10,260,696 B2
(45) Date of Patent: Apr. 16, 2019

(54) LIGHT-EMITTING DIODE MODULE HOLDER

(71) Applicant: KEEPER TECHNOLOGY CO., LTD., New Taipei (TW)

(72) Inventors: Chung-Hsien Kuo, New Taipei (TW); Chiu-Mei Liao, New Taipei (TW)

(73) Assignee: Keeper Technology Co., Ltd., New Taipei (TW)

( * ) Notice: Subject to any disclaimer, the term of this patent is extended or adjusted under 35 U.S.C. 154(b) by 142 days.

(21) Appl. No.: 15/388,229

(22) Filed: Dec. 22, 2016

(65) Prior Publication Data

US 2018/0180245 A1 Jun. 28, 2018

(51) Int. Cl.

| | |
|---|---|
| ***F21S 41/19*** | (2018.01) |
| ***F21V 23/06*** | (2006.01) |
| ***F21V 29/503*** | (2015.01) |
| ***F21V 29/76*** | (2015.01) |
| ***F21S 45/47*** | (2018.01) |
| ***F21S 41/141*** | (2018.01) |

(52) U.S. Cl.

CPC ..... *F21S 41/192* (2018.01); *F21S 41/141* (2018.01); *F21S 45/47* (2018.01); *F21V 23/06* (2013.01); *F21V 29/503* (2015.01); *F21V 29/763* (2015.01)

(58) Field of Classification Search

CPC ..... F21S 41/192; F21S 41/141; F21S 45/47; F21V 29/503; F21V 29/763

USPC ..... 362/547

See application file for complete search history.

(56) References Cited

U.S. PATENT DOCUMENTS

| | | | |
|---|---|---|---|
| 7,290,913 | B2 | 11/2007 | Watanabe et al. |
| 7,750,458 | B2 | 7/2010 | Takeda et al. |
| 7,901,123 | B2 | 3/2011 | Takeda et al. |
| 8,016,469 | B2 | 9/2011 | Takeda et al. |
| 8,328,401 | B2 | 12/2012 | Matsunaga |
| 8,523,416 | B2 | 9/2013 | Ohmi et al. |

(Continued)

FOREIGN PATENT DOCUMENTS

| | | | |
|---|---|---|---|
| CN | 202266955 | U | 6/2012 |
| TW | M460990 | U1 | 9/2013 |

(Continued)

OTHER PUBLICATIONS

Official Action for corresponding Taiwan Application No. 105134540, six pages, dated Jan. 5, 2017.

(Continued)

*Primary Examiner* — Anh T Mai
*Assistant Examiner* — Meghan K Ulanday
(74) *Attorney, Agent, or Firm* — C. G. Mersereau; DeWitt LLP

(57) ABSTRACT

A light-emitting diode (LED) module holder includes a seat, a first holding member, a second holding member, an LED module and two terminals. The LED module is mounted on the seat. The seat has multiple positioning bosses formed thereon to stop the LED module from moving horizontally. The first holding member and the second holding member are mounted on a rear portion and a front portion of a top of the seat, and the first holding member and the second holding member respectively have a first pressing portion and a second pressing portion that fasten the LED module to prevent the LED module from moving vertically. Accordingly, loose contact of electrical connection portions in the LED module holder arising from issues of alignment and fixing can be avoided.

15 Claims, 8 Drawing Sheets

(56) References Cited

U.S. PATENT DOCUMENTS

| | | | |
|---|---|---|---|
| 8,602,619 | B2 | 12/2013 | Matsunaga |
| 8,801,251 | B2 | 8/2014 | Ohmi et al. |
| 9,035,346 | B2 | 5/2015 | Matsunaga et al. |

FOREIGN PATENT DOCUMENTS

| | | | |
|---|---|---|---|
| TW | M498387 | U | 4/2015 |
| TW | 201516317 | A | 5/2015 |
| TW | M513329 | U | 12/2015 |
| TW | M514537 | U | 12/2015 |

OTHER PUBLICATIONS

Official Action for corresponding Taiwan Application No. 105132013, eight pages, dated Apr. 21, 2017.

LIGHT-EMITTING DIODE MODULE HOLDER

BACKGROUND OF THE INVENTION

1. Field of the Invention

The present invention relates to a light-emitting diode (LED) module holder and, more particularly, to an LED module holder mounted in a headlight of a vehicle.

2. Description of the Related Art

With reference to FIG. 8, conventionally, regular light source mounted inside a vehicular headlight pertains to an LED module 90. The LED module 90 includes a substrate 93 with LED dies thereon and a ceramic circuit board 91 with two electrodes 95. The substrate 93 is mounted on the ceramic circuit board 91. After the LED module 90 is mounted on a lower seat (not shown), an upper seat 80 is mounted on a top of the LED module 90 and has a base 81 and a connector 83. The base 81 has an opening 810, multiple stoppers 84, and two electrical contacts 85. The opening 810 is formed through the base 81. The multiple stoppers 84 are formed on an inner edge of the opening 810. The two electrical contacts 85 are mounted on and protrude inwards from the inner edge of the opening 810. The connector 83 is formed on one end of the base 81 and has two terminals 86 mounted therein and electrically connecting with the respective electrical contacts 85 of the base 81. After the upper base 80 is mounted on the LED module 90, the two electrodes 95 are tightly connected with the respective electrical contacts 85 of the upper base 80 for the substrate 93 to be electrically connected with the two terminals 86 of the connector 83. As limited by the stoppers 84, the substrate 93 is held inside the opening 810.

However, the foregoing LED module fixing approach has the following drawbacks:

1. In view of the necessity of being mounted on the upper base 80 and the lower base, alignment among the LED module 90, the upper base 80 and the lower base for ensuring a correct and accurate mounting thus causes inconvenience in assembly.

2. Because the two electrical contacts 85 and the respective electrodes 95 abut against each other, loose contact between the electrical contacts 85 and the electrodes 95 may be caused after a long while. For example, when the upper base 80 slightly comes loose, there is a high likelihood that loose contact between the LED module 90 and the terminals 86 may be caused.

SUMMARY OF THE INVENTION

An objective of the present invention is to provide a light-emitting diode (LED) module holder with a detachable structure facilitating assembly thereof.

To achieve the foregoing objective, the light-emitting diode (LED) module holder includes a seat, a first holding member, a second holding member, two terminals and an LED module.

The seat has a raised portion and four engagement slots. The raised portion is formed on a top of the seat. Two of the engagement slots are formed in a front side of the raised portion, and the other two of the engagement slots are formed in a rear side of the raised portion.

The first holding member is mounted on the seat with a part of the first holding member mounted on the top of the raised portion and a remaining part of the first holding member mounted on a rear portion of the top of the seat, and has two first engagement arms and a first pressing portion.

The two first engagement arms are formed on and protrude from a front side of the first holding member and are mounted through the two respective engagement slots on the rear side of the raised portion of the seat.

The first pressing portion is corner-shaped with a vertical portion formed on and protruding upwards from a front edge of a top side of the first holding member and a horizontal portion formed on and protruding forwards from a top edge of the vertical portion.

The second holding member is mounted on the seat with a part of the second holding member mounted on the top of the raised portion of the seat and a remaining part of the second holding member mounted on a front portion of the top of the seat, and has two second engagement arms, a connection port and a second pressing portion.

The two second engagement arms are formed on and protrude from a rear side of the second holding member and are mounted through the two respective engagement slots on the front side of the raised portion of the seat.

The connection port is formed on a front side of the second holding member.

The second pressing portion is corner-shaped and has a vertical portion and at least one horizontal portion. The vertical portion is formed on and protrudes upwards from a rear edge of a top side of the second holding member. The at least one horizontal portion is formed on and horizontally protrudes rearwards from a top edge of the vertical portion.

The two terminals are securely mounted in the second holding member. Each terminal has an insertion end and an electrical connection end. The insertion end is mounted through the connection port.

The LED module is mounted on the raised portion of the seat and has a substrate, two electrical contacts and an LED die.

The substrate is mounted on the raised portion of the seat and is held by the first holding member and the second holding member.

The two electrical contacts are mounted on the substrate and are electrically connected to the electrical connection ends of the respective terminals.

The LED die is mounted on the substrate.

The LED module holder is advantageous in that after the LED module is mounted on the seat, as the horizontal movement of the LED module is limited by those positioning bosses, the LED module will not horizontally move when inadvertently touched by other elements mounted to the LED module holder. Because the first holding member and the second holding member can be mounted on a rear portion and a front portion of the seat by using the first engagement arms and the second engagement to engage the engagement slots, alignment of the LED module and the seat should be easy and less critical and the LED module holder can be rapidly assembled in a right way. Also because the LED module is held by the first holding member and the second holding member and the vertical movement of the LED module is restricted, the LED module can be securely mounted on the seat with a two-fold holding effect.

Other objectives, advantages and novel features of the invention will become more apparent from the following detailed description when taken in conjunction with the accompanying drawings.

DETAILED DESCRIPTION OF THE INVENTION

Figure 1:
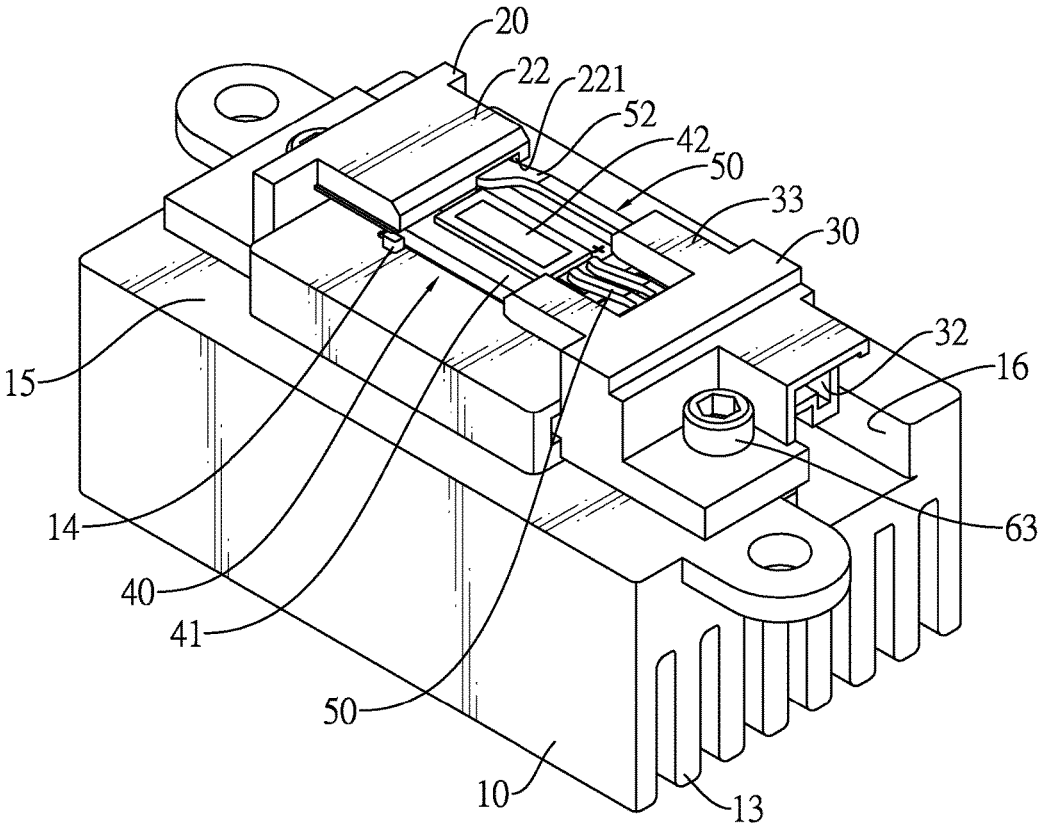
FIG. 1 is a perspective view of an LED module holder in accordance with the present invention.
Figure 2:
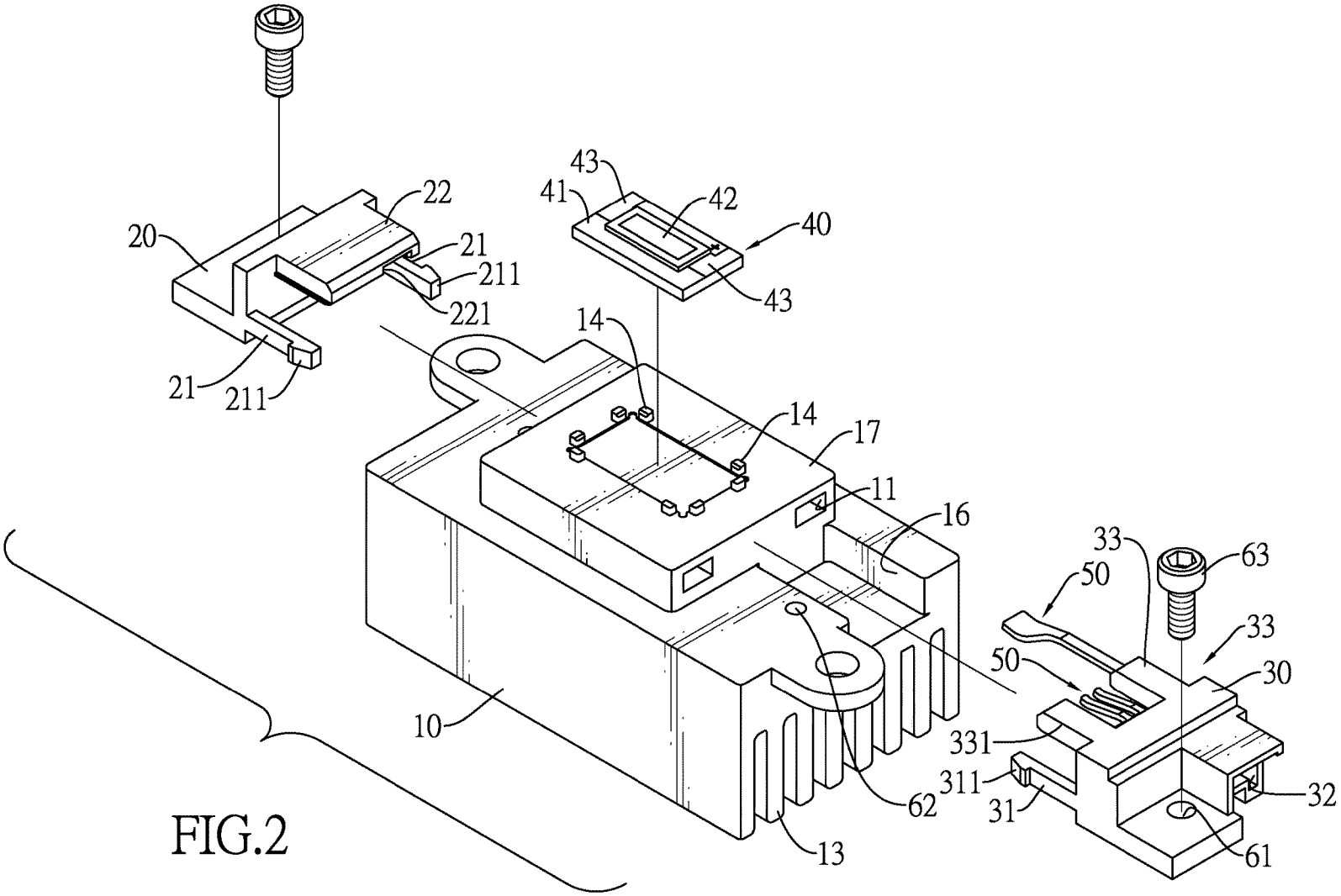
FIG. 2 is an exploded perspective view of the LED module holder in FIG. 1.
Figure 3:
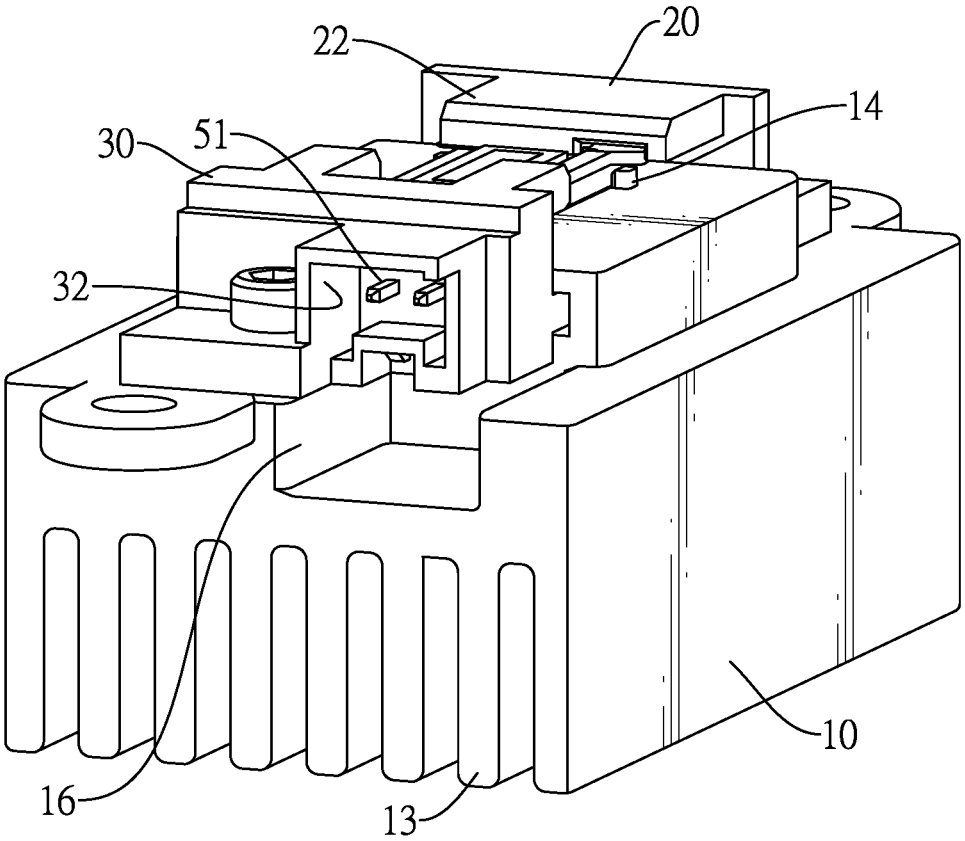
FIG. 3 is another perspective view of the LED module holder in FIG. 1.

With reference to FIGS. 1 to 3, a light-emitting diode (LED) module holder in accordance with the present invention includes a seat 10, a first holding member 20, a second holding member 30, an LED module 40 and two terminals 50.

Figure 5:
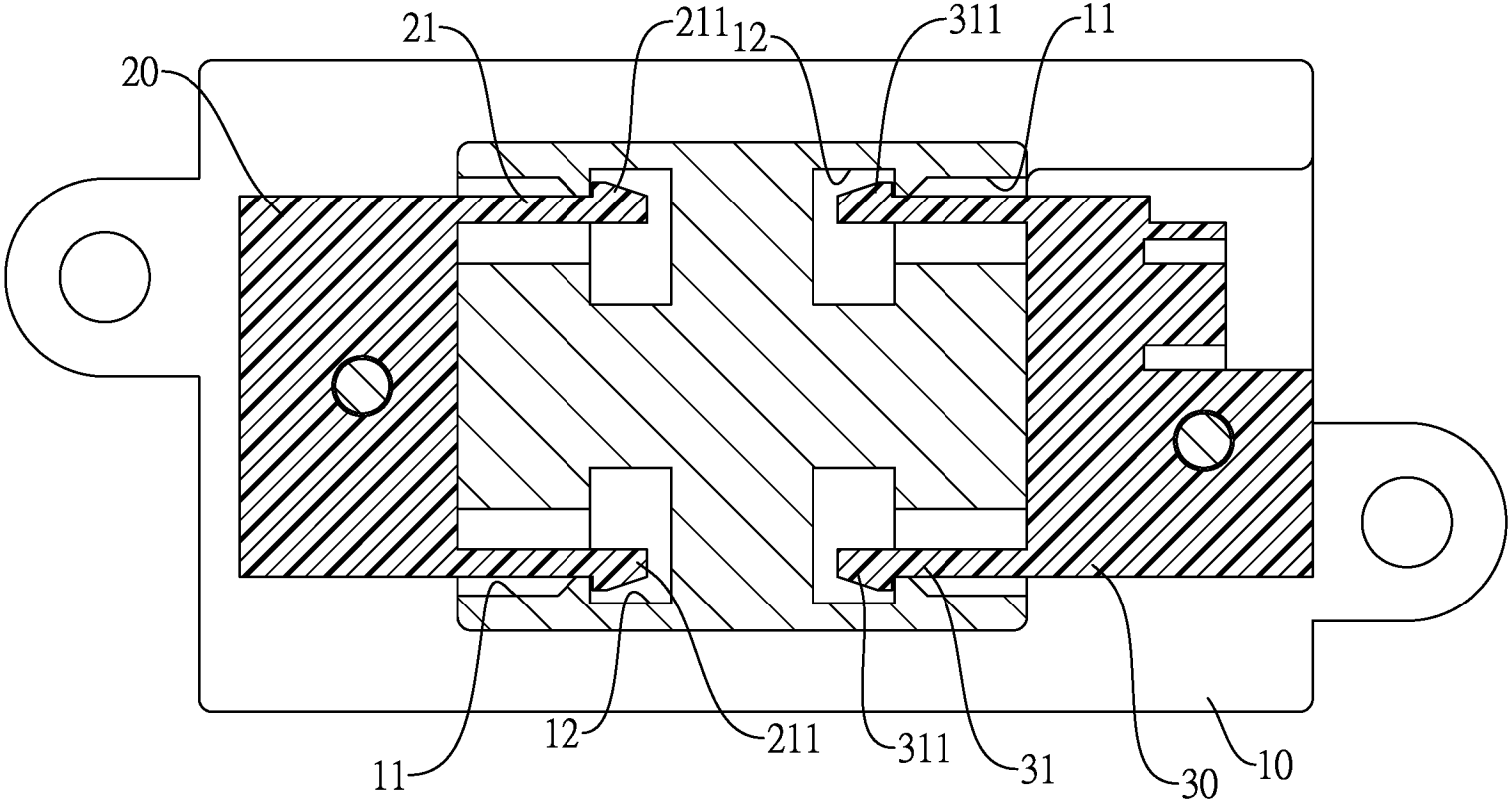
FIG. 5 is a cross-sectional view of the LED module holder in FIG. 1.
Figure 6:
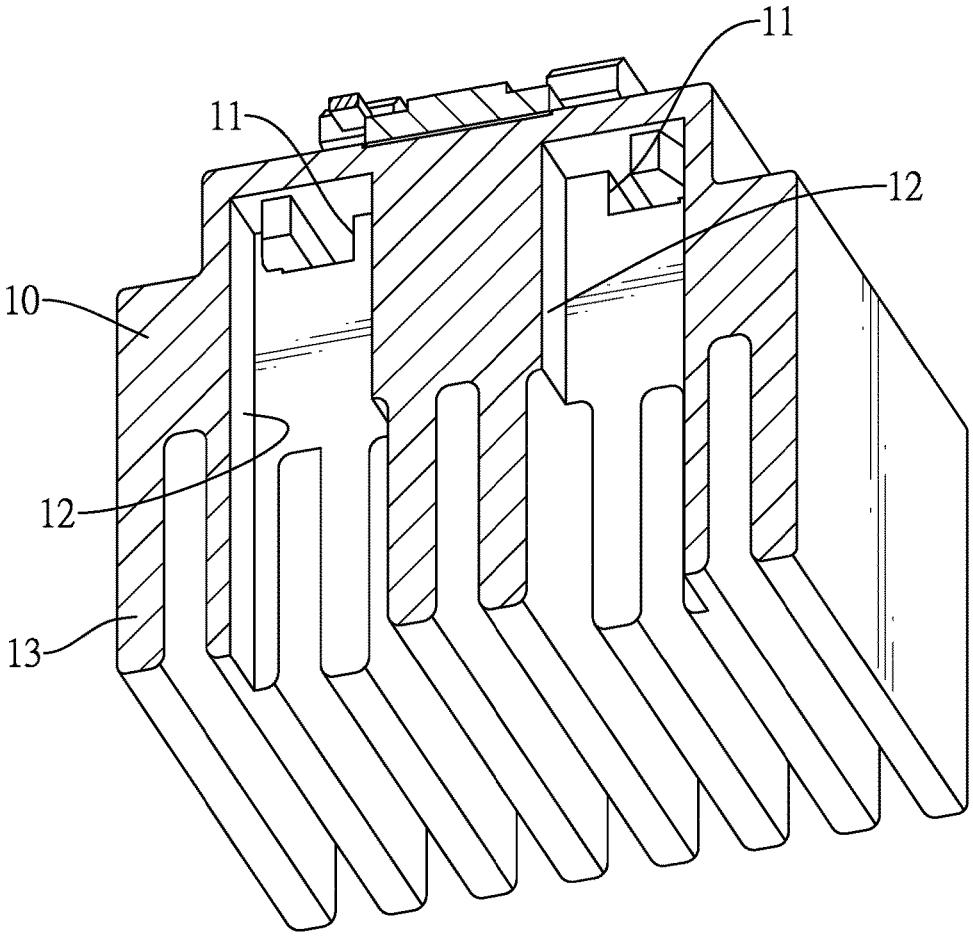
FIG. 6 is cross-sectional perspective view of the LED module holder in FIG. 1.

With reference to FIGS. 2, 5 and 6, the seat 10 is a rectangular block and has a raised portion 17, four engagement slots 11 and four channels 12. The raised portion 17 is formed on a top of the seat 10. Two of the engagement slots 11 are formed in a front side of the raised portion 17, and the other two of the engagement slots 11 are formed in a rear side of the raised portion 17. The four channels 12 are formed in a bottom of the seat 10 to adjoin, communicate with, and align with the respective engagement slots 11 in a front-rear direction.

With reference to FIGS. 1, 3 and 6, the seat 10 further has multiple heat-dissipating fins 13 and multiple positioning bosses 14. The multiple heat-dissipating fins 13 are formed on the bottom of the seat 10 and spaced apart from each other by gaps. The multiple positioning bosses 14 are formed on a top of the raised portion 17 and are spaced apart from each other by gaps. In the present embodiment, the seat 10 is made of a material including but not limited to ceramics, metal or other heat-conductive materials.

With reference to FIGS. 1, 2 and 5, the first holding member 20 is mounted on the seat 10 with a part of the first holding member 20 mounted on the top of raised portion 17 and a remaining part of the first holding member 20 mounted on a rear portion of the top of the seat 10, and has two first engagement arms 21 and a first pressing portion 22. The first engagement arms 21 are formed on and protrude from a front side of the first holding member 20. Each first engagement arm 21 has a barbed end 211 and is sequentially mounted through a corresponding engagement slot 11 on the rear side of the raised portion 17 and a corresponding channel 12 with the barbed end 211 retained in the corresponding channel 12. The first pressing portion 22 is corner-shaped with a vertical portion formed on and protruding upwards from a front edge of a top side of the first holding member 20 and a horizontal portion formed on and protruding forwards from a top edge of the vertical portion, and has a terminal recess 221 formed in a bottom of the horizontal portion of the first pressing portion 22.

With reference to FIGS. 1 to 3, the second holding member 30 is mounted on the seat 10 with a part of the second holding member 20 mounted on the top of raised portion 17 of the seat 10 and a remaining part of the second holding member 20 mounted on a front portion of the top of the seat 10, and has two second engagement arms 31, a connection port 32 and a second pressing portion 33. The second engagement arms 31 are formed on and protrude from a rear side of the second holding member 30. Each second engagement arm 31 has a barbed end 311 and is sequentially mounted through a corresponding engagement slot 11 on the front side of the raised portion 17 and a corresponding channel 12 with the barbed end 311 retained in the corresponding channel 12. The connection port 32 is formed on a front side of the second holding member 30 opposite to the rear side of the second holding member 30. The second pressing portion 33 is corner-shaped with a vertical portion formed on and protruding upwards from a rear edge of a top side of the second holding member 30 and at least one horizontal portion 331 formed on and horizontally protruding rearwards from a top edge of the vertical portion. In the present embodiment, there are two horizontal portions 331.

Figure 7:
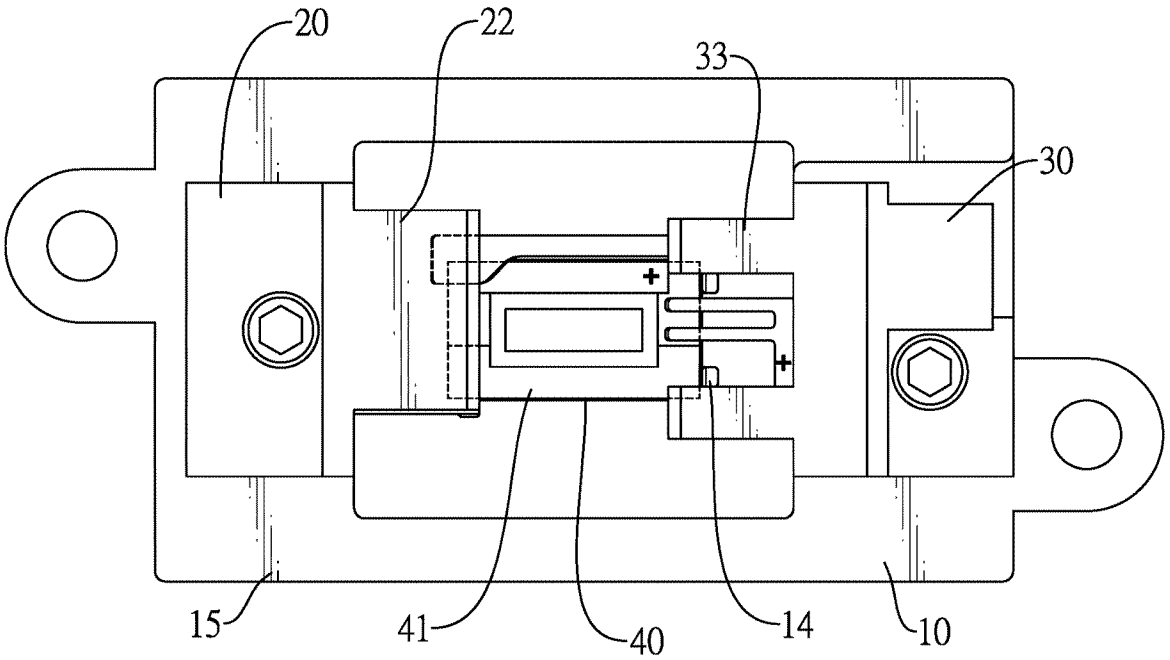
FIG. 7 is a top view of the LED module holder in FIG. 1.
Figure 8:
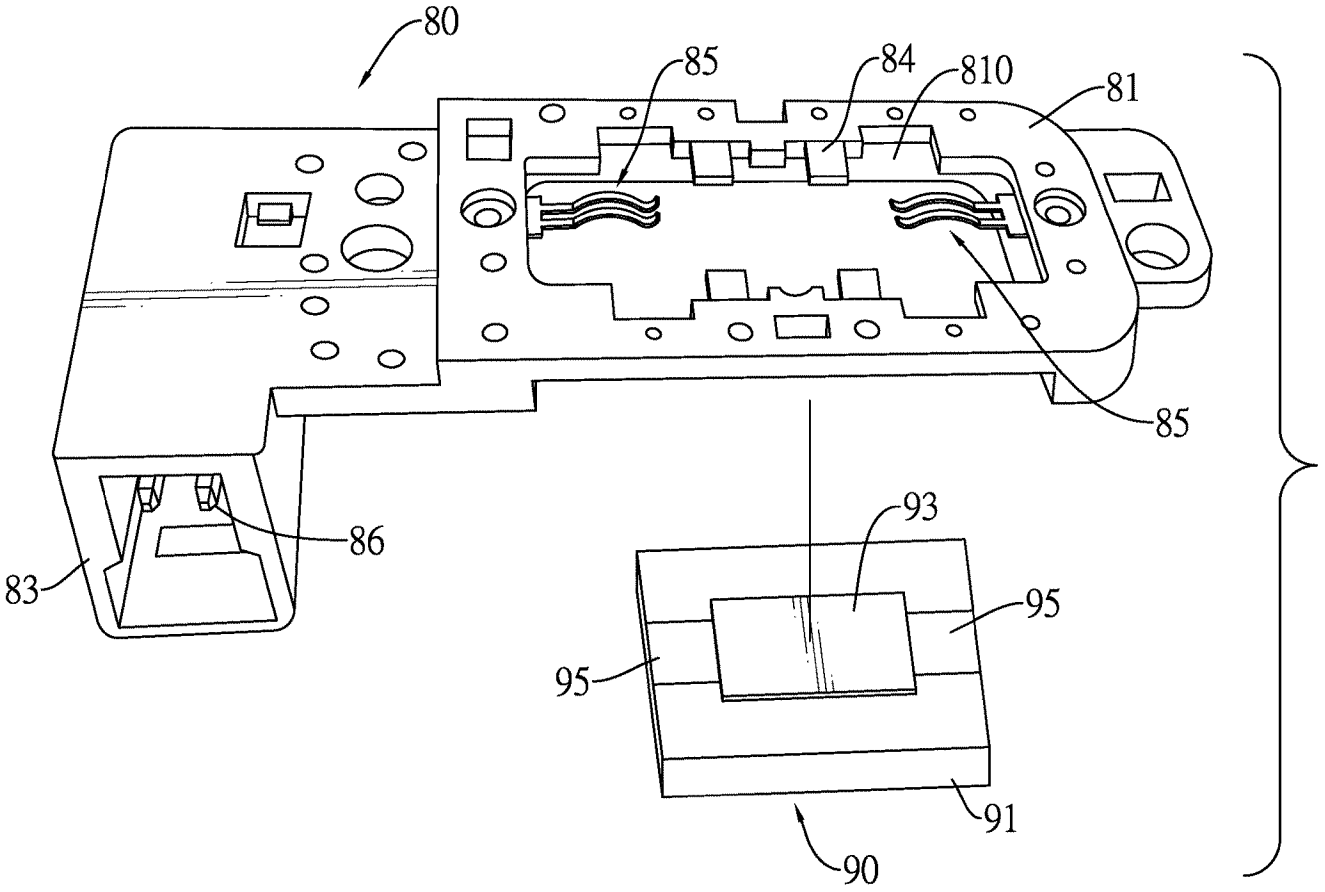
FIG.8 PRIOR ART
FIG. 8 is an exploded perspective view of a conventional LED module holder.

With reference to FIGS. 1, 2 and 7, the LED module 40 is mounted on the raised portion 17 of the seat 10 and includes a substrate 41, an LED die 42 and two electrical contacts 43. The substrate 41 may be but may not be limited to a rectangular board. A perimeter of the substrate 41 abuts against the multiple positioning bosses 14, such that the substrate 41 is prevented from moving horizontally. In the present embodiment, there are eight positioning bosses 14. Two of the positioning bosses 14 respectively abut against each two intersecting edges of the substrate 41 for the substrate 41 to be securely positioned on the seat 10. However, the multiple positioning bosses 14 may have other quantity and way of formation. The two electrical contacts 43 are respectively mounted on a front portion and a rear portion of the substrate 41 and are adjacent to the first holding member 20 and the second holding member respectively. The LED die 42 is centrally mounted on the substrate 41 and is located between the two electrical contacts 43.

Figure 4:
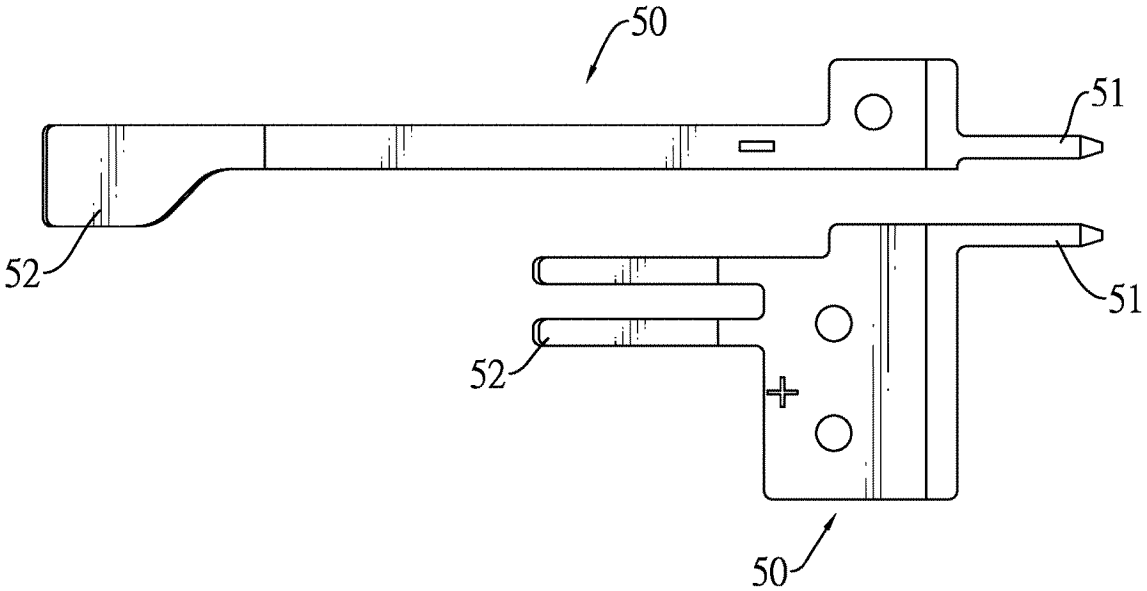
FIG. 4 is a top view of two terminals of the LED module in FIG. 2.

With reference to FIGS. 1, 2 and 4, the two terminals 50 are securely mounted in the second holding member 30. The second holding member 30 is made by injection molding to wrap around the two terminals 50 with free ends of the two terminals 50 protruding beyond the second holding member 30. The two terminals 50 may be mounted in the second holding member 30 through other means. For example, the two terminals 50 may be securely mounted in the second holding member 30 by way of insertion. Each terminal 50 has an insertion end 51 and an electrical connection end 52. The two insertion ends 51 of the two terminals 50 are mounted through the connection port 32 to be electrically connected to an external power source. The two electrical connection ends 52 extend to and abut against the respective electrical contacts 43 of the LED module 40 for the LED module 41 to be electrically connected to the external power source through the insertion ends 51 of the two terminals 50. As the two terminals 50 are both mounted in the second holding member 30, to reach the two electrical contacts 43 on the substrate 41 of the LED module 40, the electrical connection end 52 of one of the terminals 50 takes the form of an elongated strip and extends to the terminal recess 221 of the first holding member 20 in a direction from the second holding member 30 to the first holding member 20 to abut against an upper inner wall of the terminal recess 221.

With reference to FIGS. 2 and 7, when the LED module holder is assembled, the LED module 40 is placed on a space on the raised portion 17 of the seat delimited by the multiple positioning bosses 14, the first holding member 20 and the second holding member 30 are respectively mounted on the seat 10 by inserting the first engagement arms 21 and the second engagement arms 31 into the respective engagement slots 11 on the rear side and the front side of the raised portion 17 of the seat 10 for the LED module 40 to be held between the first holding member 20 and the second holding member 30. After completion of the assembly, the substrate 41 is held by the first pressing portion 22 of the first holding member 20 and the at least one horizontal portion 331 of the second holding member 30. Due to the pressing of the first holding member 20 and the second holding member 30 and the positioning of the multiple positioning bosses 14, the LED module 40 can be assembled on a correct position without being movable, falling off or misaligned.

With reference to FIGS. 1 and 2, each of the first holding member 20 and the second holding member 30 has a through hole 61, and the seat 10 has two blind holes 62 corresponding to the two through holes 61. A fastener 63 is mounted through the through hole 61 of each of the first holding member 20 and the second holding member 30 and a corresponding blind hole 62 to securely fasten the first holding member 20 and the second holding member 30 on the seat 10. In the present embodiment, the fastener 63 is a bolt engaging each blind hole 62 through threaded connection.

With reference to FIG. 5, after the first engagement arms 21 and the second engagement arms 31 are mounted through the respective engagement slots 11 and channels 12, as long as a tool is used to push the first engagement arms 21 and the second engagement arms 31 through the respective channels 12 from the bottom of the seat 10 to get the barbed ends 211, 311 disengaging and escaping from the respective channels 12, after the fasteners 63 are removed, the first holding member 20 and the second holding member 30 can then be detached from the seat 10 to ensure convenience in disassembly of the LED module holder.

With reference to FIG. 3, after the assembly of the LED module holder is done, the connection port 32 of the second holding member 30 is electrically connected to an external power source to provide power to the LED module 40 for lighting purpose. The seat 10 further has an indentation 16 formed in the front portion of the top of the seat 10 and is located beneath the connection port 32 to provide more space for the connection port 32 to be connected with or disconnected from the external power source.

As the seat 10 of the LED module holder is made of ceramics, heat generated from the LED module 40 can be rapidly dissipated to avoid the LED module to be damaged for being overheated. The heat-dissipating fins 13 on the bottom of the seat 10 further accelerates the heat dissipation speed.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light-emitting diode (LED) module holder, comprising:

a seat having:

a raised portion formed on a top of the seat;

multiple positioning bosses formed on the top of the raised portion and spaced apart from each other by gaps; and four engagement slots, two of the engagement slots formed in a front side of the raised portion, and the other two of the engagement slots formed in a rear side of the raised portion;

a first holding member mounted on the scat with a part of the first holding member mounted on a top of the raised portion and a remaining part of the first holding member mounted on a rear portion of the top of the seat, and having:

two first engagement arms formed on and protruding from a front side of the first holding member and mounted through the two respective engagement slots on the rear side of the raised portion of the seat; and a first pressing portion being corner-shaped with a vertical portion formed on and protruding upwards from a front edge of a top side of the first holding member and a horizontal portion formed on and protruding forwards from a top edge of the vertical portion;

a second holding member mounted on the seat with a part of the second holding member mounted on the top of the raised portion of the seat and a remaining part of the second holding member mounted on a front portion of the top of the seat, and having:

two second engagement arms formed on and protruding from a rear side of the second holding member and mounted through the two respective engagement slots on the front side of the raised portion of the seat;

a connection port formed on a front side of the second holding member; and a second pressing portion being corner-shaped and having a vertical portion formed on and protruding upwards from a rear edge of a top side of the second holding member; and at least one horizontal portion formed on and horizontally protruding rearwards from a top edge of the vertical portion of the second pressing portion;

two terminals securely mounted in the second holding member, each terminal having:

an insertion end mounted through the connection port; and an electrical connection end; and an LED module mounted on the raised portion of the seat and having:

a substrate mounted on the raised portion of the seat and held by the first pressing portion of the first holding member and the at least one horizontal portion of the second pressing portion of the second holding member of the second holding member when the first engagement arms and the second engagement arms are inserted into the respective engagement slots on the rear side and the front side of the raised portion of the seat, wherein a perimeter of the substrate abuts against the multiple positioning bosses;

two electrical contacts mounted on the substrate and electrically connected to the electrical connection ends of the two respective terminals; and an LED die mounted on the substrate.

2. The LED module holder as claimed in claim 1, wherein the second holding member is made by injection molding to wrap around the two terminals with free ends of the two terminals protruding beyond the second holding member.

3. The LED module holder as claimed in claim 2, wherein each of the first holding member and the second holding member has a through hole, the seat has two blind holes corresponding to the two through holes, and a fastener is mounted through the through hole of each of the first holding member and the second holding member and a corresponding blind hole to securely fasten the first holding member and the second holding member on the seat.

4. The LED module holder as claimed in claim 2, wherein the seat further has an indentation formed in the front portion of the top of the seat and located beneath the connection port.

5. The LED module holder as claimed in claim 1, wherein the seat further has four channels formed in a bottom of the seat to adjoin, communicate with, and align with the four respective engagement slots in a front-rear direction.

6. The LED module holder as claimed in claim 5, wherein each of the first holding member and the second holding member has a through hole, the seat has two blind holes corresponding to the two through holes, and a fastener is mounted through the through hole of each of the first holding member and the second holding member and a corresponding blind hole to securely fasten the first holding member and the second holding member on the seat.

7. The LED module holder as claimed in claim 5, wherein the seat further has an indentation formed in the front portion of the top of the seat and located beneath the connection port.

8. The LED module holder as claimed in claim 1, wherein the seat further has multiple heat-dissipating fins formed on a bottom of the seat and spaced apart from each other by gaps.

9. The LED module holder as claimed in claim 8, wherein each of the first holding member and the second holding member has a through hole, the seat has two blind holes corresponding to the two through holes, and a fastener is mounted through the through hole of each of the first holding member and the second holding member and a corresponding blind hole to securely fasten the first holding member and the second holding member on the seat.

10. The LED module holder as claimed in claim 8, wherein the seat further has an indentation formed in the front portion of the top of the seat and located beneath the connection port.

11. The LED module holder as claimed in claim 1, wherein the first holding member has a terminal recess formed in a bottom of the horizontal portion of the first pressing portion, and the electrical connection end of one of the terminals takes the form of an elongated strip and extends to the terminal recess of the first holding member in a direction from the second holding member to the first holding member to abut against an upper inner wall of the terminal recess.

12. The LED module holder as claimed in claim 11, wherein each of the first holding member and the second holding member has a through hole, the seat has two blind holes corresponding to the two through holes, and a fastener is mounted through the through hole of each of the first holding member and the second holding member and a corresponding blind hole to securely fasten the first holding member and the second holding member on the seat.

13. The LED module holder as claimed in claim 11, wherein the seat further has an indentation formed in the front portion of the top of the seat and located beneath the connection port.

14. The LED module holder as claimed in claim 1, wherein each of the first holding member and the second holding member has a through hole, the seat has two blind holes corresponding to the two through holes, and a fastener is mounted through the through hole of each of the first holding member and the second holding member and a corresponding blind hole to securely fasten the first holding member and the second holding member on the seat.

15. The LED module holder as claimed in claim 1, wherein the seat further has an indentation formed in the front portion of the top of the scat and located beneath the connection port.

* * * * *